United States Patent [19]

Berry, III

[11] Patent Number: 4,881,058

[45] Date of Patent: Nov. 14, 1989

[54] COMBINED AUDIBLE AND VISUAL ALARM SYSTEM

[75] Inventor: Robert W. Berry, III, Bridgeport, Conn.

[73] Assignee: Audiosone, Inc., Stratford, Conn.

[21] Appl. No.: 262,459

[22] Filed: Oct. 25, 1988

[51] Int. Cl.[4] ..... G08B 27/00

[52] U.S. Cl. ..... 340/326; 340/384 R; 340/384 E; 340/500; 340/508

[58] Field of Search ..... 340/326, 328, 329, 330, 340/384 R, 384 E, 512, 513, 825.24, 825.25, 508

[56] References Cited

U.S. PATENT DOCUMENTS

| | | | |
|---|---|---|---|
| 3,309,685 | 3/1967 | Manning . | |
| 3,311,831 | 3/1967 | Leppert . | |
| 3,448,447 | 6/1969 | Tetherow . | |
| 3,531,594 | 9/1970 | Dickerson . | |
| 3,569,964 | 3/1971 | Mande . | |
| 3,611,362 | 10/1971 | Scott . | |
| 3,618,081 | 11/1971 | Morrow . | |
| 3,656,158 | 4/1972 | Goodwater . | |
| 3,711,854 | 1/1973 | Reynolds et al. . | |
| 3,906,491 | 9/1975 | Gosswiller et al. . | |
| 3,912,883 | 10/1975 | Goodyear . | |
| 3,936,821 | 2/1976 | Cooper et al. . | |
| 3,964,047 | 6/1967 | Antonaccio | 340/310 R |
| 4,101,880 | 7/1978 | Haus | 340/326 |
| 4,258,332 | 3/1981 | West . | |
| 4,274,084 | 6/1981 | Haus | 3240/326 |
| 4,703,312 | 10/1987 | Berry, III | 340/506 |

*Primary Examiner*—Donnie L. Crosland

*Attorney, Agent, or Firm*—H. Gibner Lehmann; K. Gibner Lehmann

[57] ABSTRACT

A combination audio and visual alarm system for selectively generating either audible, or visual, or combined audible and visual alarm signals, including a sound transducer device having a blocking capacitor connected thereto, a polarity-responsive electrical lamp, and a two-conductor circuit connected with the sound transducer device and with the lamp. In addition, there is a source of d. c. and a source of audio signals. A switch connects the two-conductor circuit to either the d.c. source or the audio source, thereby to enable simultaneous operation of the sound transducer and the lamp upon energization of the circuit by the source of audio, or to enable sole operation of the lamp when the circuit is energized by d.c.

25 Claims, 4 Drawing Sheets

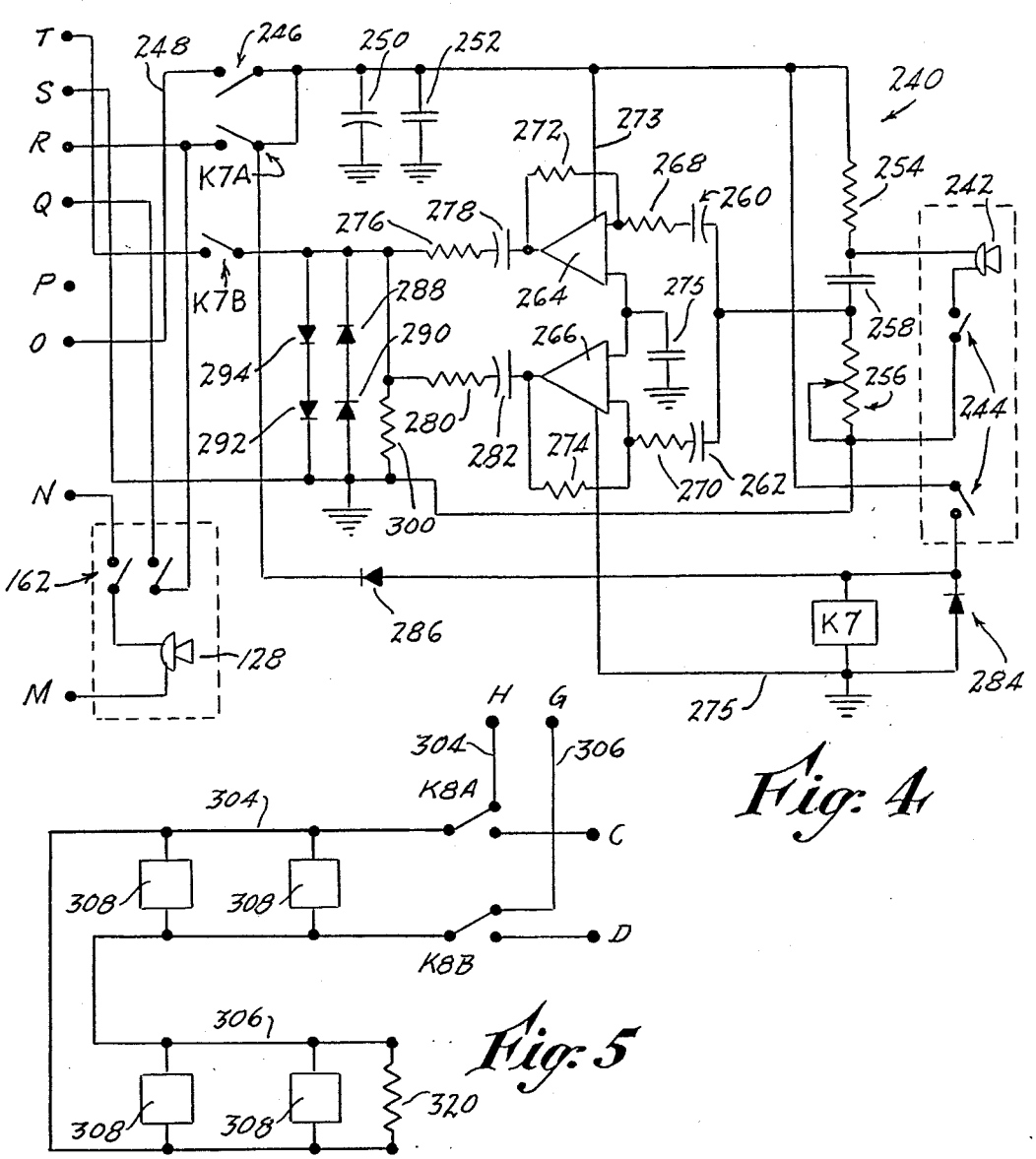
Fig. 4
Fig. 5
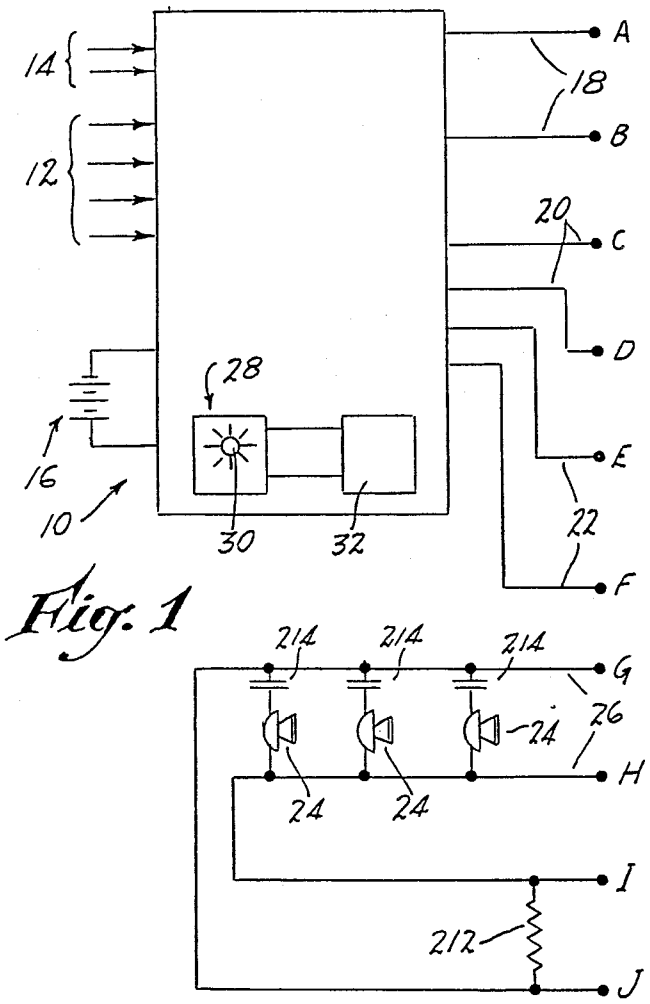
Fig. 1

COMBINED AUDIBLE AND VISUAL ALARM SYSTEM

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to emergency alarm systems, and more particularly to alarm systems having both audible and visual signal devices located remotely from a master control panel.

2. Description of the Related Art

It is generally recognized that conventional fire alarm control panels have now been developed to the point where they are considered to be highly reliable. In buildings protected by such panels, when an alarm is sounded the occupants readily acknowledge the existence of a potential danger and quickly vacate the premises. However, many such conventional alarm systems give no indication of the severity of the danger, nor where the danger point is, or what would be the best course of action to pursue, as well as whether or not the alarm might be false. A situation having variables such as these could result in either inaction, or improper action and unnecessary injury.

The above drawback has been recognized, and improvements have been made by replacing the electromechanical bells and horns with loud speakers, and by providing an electronically-generated alarm signal, such as a siren, with a capability for voice over ride whereby a qualified person can communicate important information to the building occupants in an emergency situation.

There exist several methods of upgrading an existing alarm system to one having both alarm signal and voice capabilities. One approach is to completely scrap the existing alarm panel and replace it with a modernized one having the desired voice amplification and speaker circuitry. However, this is usually very costly. An alternative is to add an adapter module which can provide the desired combined voice and signal capabilities while still retaining the advantages of alarm detection and circuitry supervision of the already existing alarm control panel.

The present invention relates to improvements in the alarm apparatus disclosed and claimed in my U.S. Pat. No. 4,703,312 dated Oct. 27, 1987.

This patented device was intended for use with two-wire systems having loud speakers connected at the desired points along the wires. A signal generator and amplifier were provided, for producing a "whoop" type sound, namely a swept 400–1400 Hz wave that had a pulse repetition rate of about one second.

In addition to this, a voice-override capability was built into the system, wherein operation of a microphone button silenced the signal generator if it was active, and enabled the transmission of verbal messages over the speakers. Transmission of verbal messages under non-alarm conditions was also featured.

In some installations it is desired to have both an audible warning system, and a visual warning system, the latter usually taking the form of a flashing light, which periodically produces high-intensity light pulses. This usually meant the use of a 4-wire system, two being for transmission of the audio, and the remaining two carrying d.c., for the flashing light. Such requirements presented only minor problems when the wiring was being installed at the time during which a building was under construction. However, for existing buildings and alarm installations having exclusively two-conductor lines, the addition of the flashing light meant re-wiring of the entire complex, which was both costly and time-consuming.

Examples of existing audio/visual alarms are shown in U.S. Pat. Nos. 4,274,084; 4,101,880; and 4,258,332.

In U.S. Pat. No. 4,274,084, there is disclosed a circuit for producing periodic flashes of light, generated by a neon-triggered flashtube, and in addition, synchronized bursts from a bell or chime. The circuit has no provision for disabling either mode of alarm while permitting the other to remain active. Nor is there any provision for transmission of voice messages.

U.S. Pat. No. 4,101,880 relates to an audio-visual alarm circuit which produces flashes every one-half second or so, and a continuous "horn" sound that fluctuates in amplitude, or "pulses" with each flash. No provision is made for disabling either mode of alarm. Also, transmission of voice messages is not possible with this system.

U.S. Pat. No. 4,258,332 involves an alarm system employing multiple remotely located combination amplifier/loud speaker units which are fed by means of a 2-wire line. Provision is made for transmitting both siren-type alarm signals and voice communication. The line is fed with d.c. of sufficient amplitude to provide supply power for each amplifier; in addition, under alarm conditions, a small a.c. component containing the audio that is to be transmitted is superimposed on, or employed to "modulate" the d.c. component. At each unit, the relatively small a.c. component is separated from the d.c. and amplified by the respective amplifier. Each amplifier drives a separate speaker. Separation is accomplished at the input of the unit, by means of a rectifier and choke which block the a.c. and pass only the d.c., and a blocking capacitor, which blocks the d.c. and passes only the a.c.

The primary disadvantage of this system is that where a relatively large number of remote amplifier/-speaker units is employed, the power drain becomes excessive since each amplifier is drawing current at the same time. In the event that the system is to function during a failure of the 115 volt power mains (in which case battery back-up is employed), this power drain consideration becomes even more important. Also, the use of multiple amplifiers is deemed to be too costly, especially in view of the fact that in many current systems, there has been successfully employed only a single amplifier located at one location and having sufficient power to drive the desired number of remotely located speakers. Finally, it is believed that the reliability in such a multiple amplifier system is reduced, because the number of parts is greatly increased over that where a single amplifier is employed.

For the above reasons, it is believed that the patented device noted in the previous two paragraphs has not found wide acceptance in the industry.

Other systems are disclosed in the following patents: U.S. Pat. Nos. 3,309,685; 3,912,883; 3,611,362;

3,711,854; 3,936,821; 3,448,447; 3,569,964; and 3,618,081.

U.S. Pat. No. 3,309,685 discloses a supervised alarm circuit containing both visual and audible alarm components connected across a two-wire transmission line; no provision is made for selectively activating either visual or audible modes separately. U.S. Pat. No. 3,912,883 relates to a supervised alarm system having loud speakers connected across a two-wire line. U.S. Pat. Nos. 3,711,854, 3,448,447, 3,569,964, 3,618,081 and 3,611,362 all employ audible alarm devices, namely bells, whereas U.S. Pat. No. 3,936,821 discloses the use of either horns or bells.

SUMMARY OF THE INVENTION

The above disadvantages and drawbacks of prior alarm systems of the kind noted are obviated by the present invention, which has for one object the provision of a novel and improved alarm system which is simple in construction and reliable in operation, and which is completely compatible with virtually all existing wiring installations, requiring only two electrical leads for supplying either audible or visual, or combined audible and visual warning indications at remotely located alarm stations or units.

Another object of the invention is to provide an improved alarm system of the kind indicated, wherein combined audible and visual alarm modes are capable of being selected, to thereby increase the attention-attracting ability of the system when an emergency condition arises.

Yet another object of the invention is to provide an alarm system as above characterized, wherein complete and independent control of the audible and visual alarm modes is available at a desired, central location, and by manipulation of relatively few manual control switches in the equipment at the said location.

A still further object of the invention is to provide an improved alarm system as above set forth, wherein the audible mode is characterized by a voice-override capability.

Another object of the invention is to provide an improved alarm system as above, wherein the visual alarm mode is characterized by an audible mode override capability, and where such audible mode, when in the form of a tone signal, is characterized by a voice-override capability.

Still another object of the invention is to provide an improved alarm system of the kind noted above, wherein standby power drain is minimized, so as to prolong battery life in the event that the system is operating during failure of the a.c. power mains.

The above objects are accomplished by a combination audio and visual alarm system for selectively generating either audible, or visual, or combined audible and visual alarm signals, including a sound transducer device having d.c. blocking means connected thereto, a polarity-responsive electrical lamp, and a two-conductor circuit connected with the sound transducer device and with the lamp. In addition, there is a source of d.c. and a source of audio signals. A switch connects the two-conductor circuit to either the d.c. source or the audio source, thereby to enable simultaneous operation of the sound transducer and lamp upon energization of the circuit by the source of audio, or to enable operation of solely the lamp when the circuit is energized by d.c.

The alarm system is adaptable for use with virtually all existing fire alarm control panels, even two-wire transmission lines, and employs an extremely simple hook-up that can be accomplished with no special tools, and with little chance of error on the part of personnel installing the equipment.

Certain aspects of the invention can be summarized as follows:

1. A combination audio and visual alarm system for selectively generating either visual, or combined audible and visual alarm signals, comprising in combination:
   (a) a source of d.c.,
   (b) signal generating means for producing an audio signal on a pair of output terminals thereof,
   (c) a two-wire transmission line connected to said output terminals,
   (d) a unit containing a sound transducer and a polarity-responsive electrical lamp, and
   (e) means connected with said signal generating means, said transmission line, said sound transducer and said lamp, for selectively activating either the lamp by itself to be driven by the d.c., or both the sound transducer and lamp simultaneously to be driven by the said signal generating means.

2. A combination audio and visual alarm system for selectively generating either audible, or combined audible and visual alarm signals, comprising in combination:
   (a) signal generating means for producing an audio signal on a pair of output terminals thereof,
   (b) a two-wire transmission line connected to said output terminals,
   (c) a unit containing a sound transducer and a polarityresponsive electrical lamp, and
   (d) means for selectively activating either the sound transducer by itself to be driven by the signal generating means, or both the sound transducer and lamp simultaneously to be driven by the signal generating means.

3. An alarm system for generating audible alarm signals, comprising in combination:
   (a) signal generating means having two pairs of output terminals and having means for producing an audio signal on said output terminals,
   (b) said output terminals being supplied with substantially identical electrical voltages from a common source, through electrical switches,
   (c) a transmission line connected to one of said pair of output terminals, and extending to at least one sound transducer, and an end of line resistor in parallel therewith and located at the end of the transmission line,
   (d) two jumper wires connecting one terminal of one of said pair to a terminal of the other terminal pair, and the other jumper wire connecting the other terminal of said one pair to the other terminal of said other pair, thereby to provide redundancy in the event of inadvertent failure of one of the electrical switches, thus providing improved reliability.

4. An alarm system, comprising in combination:
   (a) signal generating means having a pair of output terminals and having means for producing an audio signal on said terminals,
   (b) a sound transducer device,
   (c) an electrical lamp,
   (d) a two-conductor circuit connected with said sound transducer device and with said lamp,
   (e) a source of d.c., and
   (f) switching means for connecting said two-conductor circuit to either said d. c. source or said signal generating means, thereby to enable simultaneous operation of said sound transducer device and lamp upon energization of the circuit by the signal generating means, or to enable sole operation of the lamp when the circuit is energized by d.c.

Other features and advantages will hereinafter appear.

BRIEF DESCRIPTION OF THE DRAWINGS

FIG. 1 is a diagrammatic representation of a conventional master fire alarm/emergency control panel having power input and output lines, alarm sensing lines, and supervisory and alarm lines for connection to external circuitry. This figure also shows a series of loud speakers of conventional design.

FIG. 4 is a schematic circuit diagram of a remote microphone module optionally employed with the interface module of FIGS. 2 and 3, and also showing a master microphone and a slave microphone. Both microphones are available for making general public address announcements, and also the master microphone is capable of overriding any alarm signals being transmitted by the interface module, thus preventing tone-type alarm signals from interfering with, voice announcements which may be of an emergency nature.

FIG. 5 is a schematic diagram of the two-wire speaker/light portion of the alarm system of the invention, this portion showing four remote alarm units connected to a two-wire transmission line, and wherein such alarm units have combined speaker/light capability.

DESCRIPTION OF THE PREFERRED EMBODIMENT

Figure 2:
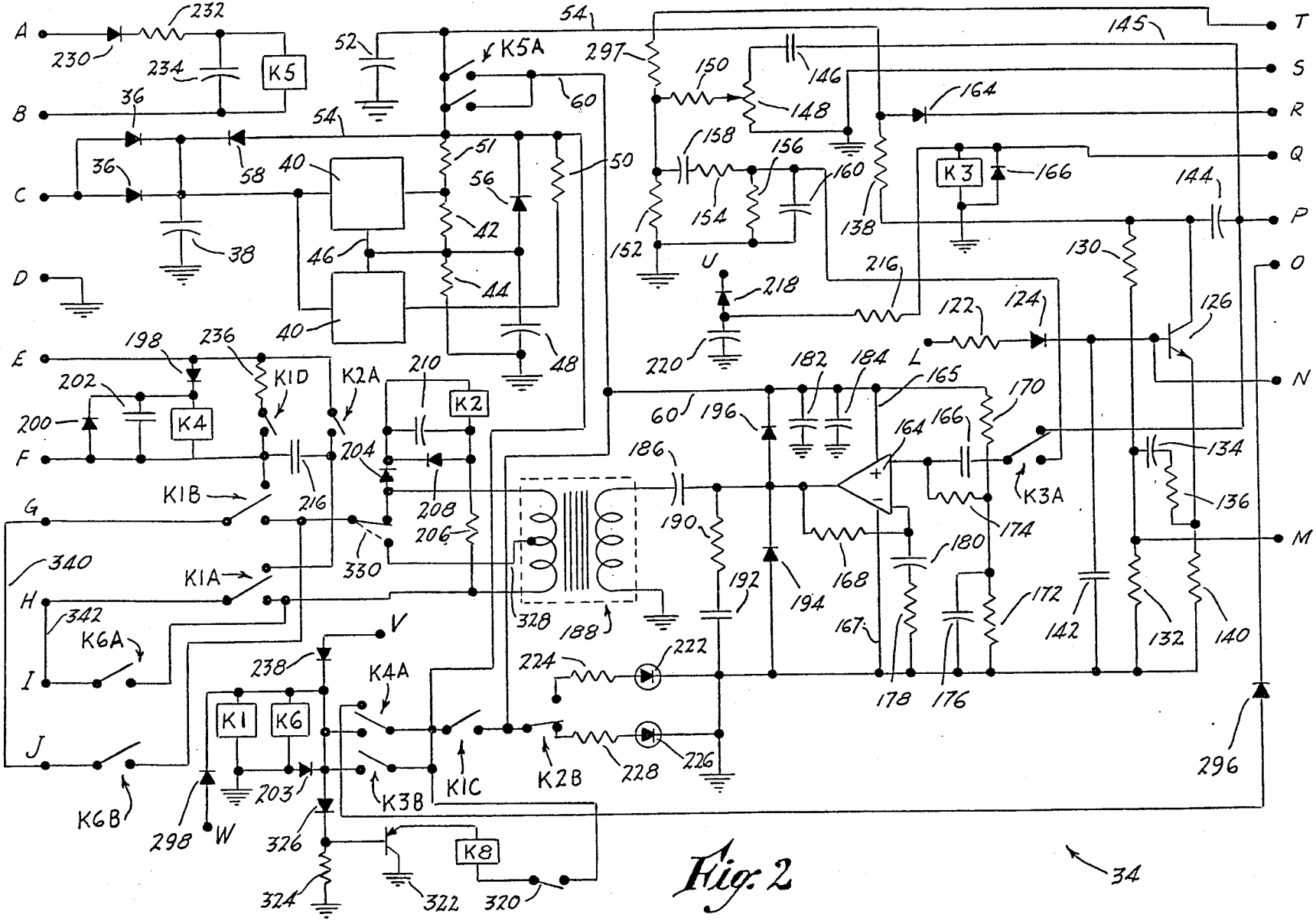
FIGS. 2 and 3 together constitute a complete schematic circuit diagram of an interface module employed with the alarm system of the present invention, adapted for connection between the existing master alarm control panel and a plurality of remotely located alarm units containing loud speakers and flashing light devices.

Referring to FIG. 1 there is diagrammatically illustrated a master fire-alarm/emergency control panel generally indicated by the numeral 10, adapted for installation in a building or other structure. Control panels such as this are currently manufactured by a number of different companies, and most such devices function in a similar manner in that they provide input lines which accept signals from remotely located sensing equipment such as smoke detectors, heat detectors, or manually-operated emergency pull-boxes, etc. The sensing equipment is generally supervised or monitored as to operativeness by the control panel 10, and electrical connections to such sensing equipment are made by multiple electrical lines indicated at 12. The panel is also supplied with nominal 115 volt a.c. power on lines 14, and in addition is connected with one or more back-up batteries which are maintained charged by suitable charging equipment (not shown) located in or around the panel 10; one such back-up battery is illustrated, indicated by the numeral 16.

The control panel 10 has outputs which provide 115 volt a.c. power on lines 18, nominal 24 volt d.c. power on lines 20 for energizing an interface module to be described below, and in addition, supervisory and alarm functions on lines 22. Those terminals of the fire alarm control panel 10 which are associated directly with the interface module have been indicated by the letters A–F respectively. One or more loud speakers 24 are provided, and permit transmission of audible messages, some of which may be of an emergency nature when conditions are warranted.

On panel 10, the voltage on terminal F is positive with respect to that on terminal E when no alarm condition has been indicated by the sensing equipment connected to one of the input lines 12. During such times, the control panel 10 monitors current flowing in lines 22 in order to verify that there exists continuity in the circuitry connected thereto (and which eventually extend to the various loud speakers 24). This current monitoring is accomplished through switching circuits of an interface module to be described below, which result in terminal E being connected with terminal H, and terminal F being connected with terminal G, as will be explained. The supervisory function of the panel 10 in monitoring the integrity of the speaker connections 26 is well known. There is illustrated a functional block 28 within the control panel 10, adapted to sense or monitor current and having a visual indicator 30 of some type such as an LED or incandescent lamp which for example, is normally off but which becomes illuminated in the event that a disruption in the continuity of the speaker lines 26 is detected. Such a lamp would also be arranged to indicate that a "problem" exists with any of the supervised input lines 12, or with other parts of the circuitry contained in the control panel 10.

In addition, the control panel 10 includes a second block 32 constituting a polarity reversing circuit, which operates to reverse the voltage applied to terminals E and F when an alarm condition is detected. Such an alarm condition would be indicated by a signal from one of the sensing devices connected to lines 12, all in the conventional manner.

Figure 3:
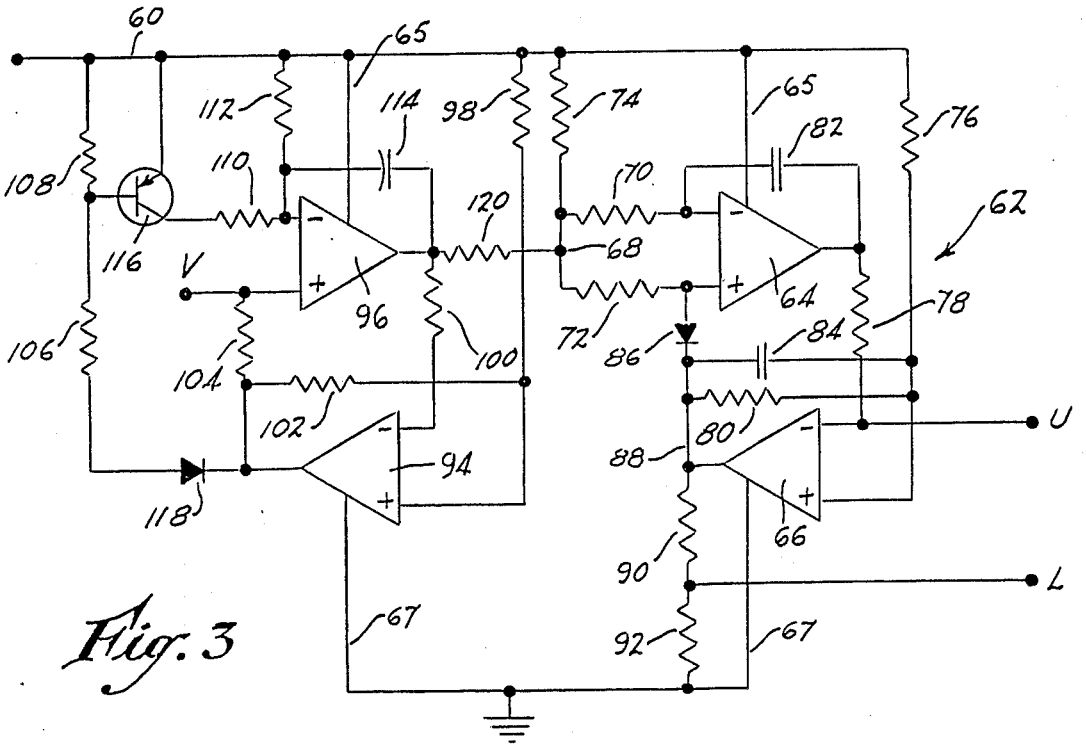

The interface module is shown in FIGS. 2 and 3. FIG. 2 contains all of the circuitry of the interface module except that involving its signal generator 62, which is shown separately in FIG. 3 due to space limitations. The present interface module is designated 34, and has terminals A–H corresponding to and adapted to be connected with the similarly labelled terminals of the alarm control panel 10 of FIG. 1, as noted above. The sheet of drawings containing FIG. 2 can be placed over the sheet containing FIGS. 1 and 4 so that the corresponding leads connected to terminals A–H align.

The interface module 34 comprises a d.c. voltage regulator in addition to the signal generator 62 shown in FIG. 3, and comprises amplifier circuitry, one or more microphones arranged to drive the amplifier circuitry, an audio transformer interposed between the amplifier circuitry and the various loud speakers, and a number of switch devices at various points about the interface module, which serve multiple functions to be described below, including controlling the operation of the microphone and alarm circuits, supervisory functions, power preservation in the event of power failure at the control panel 10, and other monitors so as to confirm that the various circuits are operating normally or are functional.

Constant d.c. power is supplied to terminals C and D of the interface module 34; diodes 36 are in parallel in order to handle the peak currents drawn by the remainder of the interface module 34. Some control panels 10 supply either raw, full-wave rectified d.c. or else only moderately filtered d.c., and accordingly a filter capacitor 38 is provided in order to smooth out any ripple. The filtered d.c. is then applied to the inputs of two integrated circuit voltage regulators 40 connected in parallel. Again, two are employed in order to handle the peak currents that are involved. The output of one regulator 40 is divided by resistors 42, 44 and fed back to the sensing terminals 46 of each regulator. A capacitor 48 reduces any pick-up of stray signals or other noise which might appear on these terminals 46. Two summing resistors 50 and 51, each on the order of one ohm or so, permit the output currents of the regulators 40 to be added, and also allow for any slight mismatch between the two units, thus avoiding a condition where one regulator unit could conceivably be handling more than its share of the load. The resistors 50, 51 extend to another filter capacitor 52, which reduces noise on the supply line 54 for the interface module 34. Two diodes 56, 58 are included in order to protect the regulator units 40 by discharging the two filter capacitors 48, 52 respectively in the event that the voltage applied to the regulator input terminals drops. This arrangement prevents a situation from arising wherein the voltages at the output and sense terminals of a regulator are greatly in excess of that appearing at its input, which would likely result in permanent damage thereto.

The supply line, indicated 54, is continuously energized and can be thought of as a "non-interrupted" positive bus or supply line. A second supply line 60 (FIGS. 2 and 3) is provided, extending to signal generator and amplifier circuitry to be described below. The second supply line 60 can be considered an "interrupted" line; it is normally connected to the uninterrupted line 54 by dual relay contacts K5A when a.c. power is being applied from the fire alarm control panel 10 to the interface module 34, but this "interrupted" line is automatically isolated by relay contacts K5A if a power failure occurs, as will be explained later.

The interface module 34 further includes the signal generator 62 particularly shown in FIG. 3, constituted as a voltage controlled oscillator and ramp generator. Four amplifiers are involved, and these can be disposed in a single package. The amplifiers have positive and negative supply lines 65 and 67 respectively. Two of the amplifiers labelled 64, 66 when connected as shown, function as a voltage controlled oscillator having a voltage control input point or line indicated at 68. Associated with the voltage-controlled oscillator are resistors 70, 72, 74, 76, 78 and 80, capacitors 82 and 84 and diode 86. The oscillator output on line 88 is divided down by resistors 90, 92 and fed to terminal L which extends to a correspondingly designate terminal L in FIG. 2 and in turn to a preamplifier transistor stage also shown in FIG. 2 and which will be described below.

The remaining two amplifiers 94, 96 when connected as shown, operate as a ramp generator having a repetition rate of about one Hz. Associated with this generator are resistors 98, 100, 102, 104, 106, 108, 110 and 112, capacitor 114, transistor 116 and diode 118. The output of amplifier 94 consists of a series of spaced, negative-going pulses; the output of the amplifier 96 is a sawtooth wave, which is applied to the voltage control input 68 of amplifier 64 through resistor 120.

As the output of amplifier 96 increases (goes more positive) a point will be reached where the current flowing into the inverting input of amplifier 94 exceeds that flowing into the non-inverting input thereof. This will in turn drive the output of this amplifier 94 low, forward biasing diode 118 and turning on the transistor 116 momentarily. This will drive current into the inverting input of the amplifier 96, causing its output to assume a low state. In turn this low condition is immediately coupled to the inverting input of the amplifier 94, thereby driving its output high and reverse-biasing the diode 118. The transistor 116 turns off, and the output of the amplifier 96 begins to rise again gradually, charging the capacitor 114. When the charging voltage increases sufficiently, the amplifier 94 will again trigger the transistor 116 into conduction for a short interval, discharging the capacitor 114, after which the output of the amplifier 94 will again assume a high state.

The sawtooth wave thus generated at the output of the amplifier 96 is applied, through resistor 120, to the control point 68 of the voltage-controlled oscillator. In operation, when the output of the amplifier 66 is high, diode 86 is reverse biased and the current flowing into the non-inverting terminal is greater than that flowing into the inverting terminal of amplifier 64, causing its output to rise and charging the capacitor 82. This rise is in the form of a positive-going ramp, and a point is reached wherein the current flowing into the inverting input terminal of the amplifier 66 exceeds that flowing into the non-inverting terminal, causing the output of the amplifier 66 to assume a low state. This in turn causes the diode 86 to become forward biased, pulling the non-inverting terminal of the amplifier 64 down and causing its output to fall, and thus discharging the capacitor 82. The fall is in the form of a negative-going ramp, so that at the output of the amplifier 64 there exists a triangular wave. Because the rates of rise and fall are determined by the charging and discharging of the capacitor 82, which in turn is effected by the currents flowing into the inputs of the amplifier 64, a change in the voltage on line 68 affects the oscillation frequency. Accordingly, the sawtooth generator and voltage controlled oscillator produce a waveform at the output of the amplifier 66, which comprises a swept 400–1400 Hz audio wave, one sweep occurring each second or so. There is thus produced a "whoop" signal that has been found to be extremely effective as far as drawing the attention of personnel in the area.

Line 60 in FIG. 3 is part of line 60 in FIG. 2, and terminal U of the circuit of FIG. 3 is employed in connection with a momentary disabling of the signal generator of FIG. 3, as will be further explained.

Referring again to FIGS. 2 and 3, the output of the amplifier 66 is a substantially symmetrical square wave, and after being divided down through the resistors 90, 92 it is fed through terminal L, which is connected to terminal L of FIG. 2. In turn, this latter terminal is connected to a series resistor 122 and isolation diode 124 leading to a transistor pre-amplifier stage 126 which constitutes a part of the amplifier circuitry of the interface module 34. A master microphone 128 (FIG. 4) that is located adjacent to the interface module 34 is shown connected to terminals M and N. The microphone 128 is preferably of the low-impedance dynamic type, and the coil thereof (not shown) is connected (through terminal M) to the junction of two biasing resistors 130, 132, and connected (through terminal N) to the base of the transistor 126. From the junction of the resistors 130, 132 there extends a series capacitor 134 and resistor 136 that in turn are connected to the emitter of the transistor 126. The impedance at the junction of the resistors 130, 132 is low, and there is thus established a good reference point for connection to that one side of the microphone coil that is not connected to the transistor base. A resistor 138 constitutes the collector load, and together with a resistor 140, the gain of the stage 126 is set. A small amount of negative feedback is provided by virtue of the connection of the resistor 130 to the collector. A small by-pass capacitor 142 at the base of transistor 126 is provided, for stability.

Output is taken off the collector of the transistor 126, through a coupling capacitor 144. An auxiliary output terminal P can optionally be provided.

The sheet of drawings containing FIG. 2 can be placed over the sheet containing FIGS. 1 and 4 such that the leads extending to terminals M, N, etc. align.

The output of the stage 126 is fed along a line 145 through an additional coupling capacitor 146 to a potentiometer 148 constituting an attenuator, the wiper arm of which is connected through a resistor 150 to a bandpass filter comprising resistors 152, 154, 156 and capacitors 158 and 160. The bandpass filter has lower and upper roll-off frequencies of 400 and 4000 Hz respectively. It has been determined that by restricting the transmission of voice signals to this range, improved intelligibility and understandability can be realized, as compared with voice transmissions which extend over the entire range of response of the human ear, which is typically up to 18 or 20 kHz. The output of the filter extends to the lower one of relay contacts K3A, the coil K3 associated therewith being operated by the push-to-talk switch 162 (FIG. 4) of the master microphone 128. The signal is then fed to the input of a power amplifier stage, to be described.

The master microphone 128 is keyed into operation by the double pole "push-to-talk" switch 162, FIG. 4, one section of which is connected to terminals Q and R. These correspond to terminals Q and R of the interface module 34 of FIG. 2. Terminal R of the interface module 34 provides voltage from line 54 through diode 164, for operation of the master microphone relay coil K3 connected to terminal Q. The relay coil K3 has a diode 166 across it, to supress induced voltages resulting from sudden interruption of the current through it, as can occur when it is de-energized.

The remainder of the amplifier circuitry will now be described. In addition to controlling the contacts K3A, the relay coil K3 controls contacts K3B. As noted, one function of the contacts K3A is, for microphone operation, to complete the circuit from the output of the bandpass filter to the input of an integrated circuit power stage indicated at 164. This stage has positive and negative supply leads 165, 167 respectively. With the coil K3 energized, the contact blade of the section K3A engages the lower contact. The (voice) signal is thus fed through a coupling capacitor 166 to the non-inverting input of the amplifier 164. A resistor 168 from the output provides negative feedback, and establishes the voltage gain. Bias for the noninverting input is set by resistors 170, 172 and 174, with a bypass capacitor 176 reducing any noise that might otherwise appear at the junction of these resistors. An RC network 178, 180 connected to the inverting input provides stability to the stage 164. By-pass capacitors 182, 184 are connected to the supply line 60, as shown. Two are employed, one (i. e. an electrolytic) to handle low frequency components of any noise which might appear on the supply line 60, and the other to take care of higher frequency components. The output of the stage is connected, through a coupling capacitor 186, to the primary of a driver transformer 188 with the other lead of the primary being connected to ground as shown. The output of the amplifier has a series connected resistor 190 and capacitor 192 extending to ground, for stability. Also, diodes 194 and 196 connected from the output of the amplifier stage 164 to the supply line 60 and to ground respectively, prevent this output from being inadvertently driven to a voltage below ground, or above the supply voltage. Diode protection is generally considered beneficial where inductive loads are employed, and would reduce the likelihood of damage to the amplifier 164 during no-load conditions at the transformer secondary, etc., as occur during switching of contacts K1A and K1B. The secondary of the transformer is intended to drive one or more of the loud speakers 24 connected to terminals G and H, through relay contacts to be described below.

The present arrangement has the following important advantage. The amplifier 164 is isolated, as far as d.c. is concerned, from the terminals G, H by the transformer. Further, the amplifier preferably has built-in current limiting, and thus is not damaged by an inadvertent, sustained overload, such as a short-circuit; furthermore the need for fuses is virtually eliminated. Thus, if a fault occurs, the interface module can in all likelihood, withstand the fault and immediately resume normal operation after the fault is corrected.

There is provided in the interface module 34, monitoring and switching circuitry which enable the single supervisory circuit 30 in the fire alarm control panel 10 to verify both the integrity of the connections to one or more of the loud speakers 24 that are connected to the interface module 34, and in addition, to automatically check and verify the operativeness of the signal generator 62 (FIG. 3), the preamplifier 126, the power amplifier stage 164 and transformer 188, not only as to presence of signal, but in addition to confirm the existence of a proper signal magnitude or strength at the output of the transformer 188. As a result, considerably fewer individual components are required in order to carry out the desired supervisory functions, while at the same time there occurs virtually no sacrifice in reliability.

Referring again to FIGS. 1 and 2, as noted above, the fire alarm control panel 10 applies to the terminal F with respect to terminal E, a (+) 24 volt d.c. voltage when no alarm condition exists. In the interface module, there is shown connected across the terminals E and F in FIG. 2 a relay coil K4 in series with a diode 198. The contacts associated with the coil K4 are indicated K4A. The connection of the diode 198 is such that with the above indicated polarity applied to the terminals E and F, the coil K4 will not be energized. Across the coil K4 is a diode 200, which suppresses induced voltages that result from sudden interruptions in the coil current. A capacitor 202 across the coil K4 is provided, to smooth out any ripple which might otherwise appear, so as to avoid chattering of the contacts K4A. Relay coils K1 and K6 are connected in parallel, and are arranged to be selectively energized during an alarm condition, by any one of a several sources, one being the engagement of the contact blade of K4A with its lower contact. The contact blades of sections K1A and K1B associated with relay coil K1 normally engage the upper contacts in the absence of an alarm condition. A diode 203 is connected across the paralleled coils K1 and K6, for suppression of induced voltages.

In accomplishing supervision of the signal generator 62, the amplifier 126, 164 and the driver transformer 188, an additional relay coil K2 is connected in series with a diode 204 and current limiting resistor 206 across the secondary of the transformer 188. A second diode 208 in parallel with the coil, provides suppression of induced voltages as before. Associated with the coil K2 are contacts K2A and K2B. A capacitor 210 across the coil K2 limits the speed at which the contacts K2A and K2B can operate, for modulation monitoring, as will be explained below.

Assuming that terminal F is positive with respect to terminal E, coil K4 will be de-energized. Relay contacts K2A are in series with the line extending to terminal E, and are normally closed when the relay coil K2 is energized, as when receiving an a.c. signal from the secondary of the driver transformer, which is of a magnitude sufficient to keep the coil K2 fully energized. Under such circumstances, even when no alarm condition exists, the signal generator is operative and there is thus established continuity in the loop from terminal E through relay contacts K2A to terminal H, through one of the pair of leads 26 extending to the loud speakers 24, thence through an end of line resistor 212, back through the other of the lines 26 to terminal G, and back to terminal F. The continuity is sensed by the supervisory circuit 28 of the fire alarm control panel 10, and an indication is provided by the lamp 28 to the effect that no problems exist in the speaker lines 26 or in the signal at the output of the transformer 188. Both of these supervisory functions are carried out solely through the two terminals E and F. Blocking capacitors 214 are in series with each speaker 24 such that the continuity check is limited to the lines 26 and not to the speaker coils. During supervisory activity of the speaker circuit or loop a capacitor 216 is connected across the line so as to eliminate stray signals which might be picked up, and which could conceivably be carried to a speaker and appear as noise, hum, or other undesirable sound. (The connections to terminals I and J will be explained later).

In the event that one of the speaker lines 26 exterior to the terminals G, H breaks, or a short-circuit occurs between these lines, the continuity sensed through terminals E and F by the fire alarm control panel 10 would be disturbed and a suitable warning given, as by illumination of the lamp 30, to indicate that a problem exists somewhere in the system. The indication may be by means other than illumination of a warning light, such as an audible alert, etc.

Assuming again that no alarm condition exists, if there occurs a loss of signal, or a substantial decrease in signal strength from the secondary of the driver transformer 188, the relay coil K2 will become de-energized, opening the contacts K2A. Again, this interrupts the continuity sensed by the fire alarm control panel 10, and a "problem" condition will be indicated by the lamp 30. Accordingly either type of fault will be detected by the single supervisory circuit 28 of the alarm control panel 10, and it can be readily appreciated that a large portion of the overall system is thus being monitored in this manner, with fairly few components. In particular, the integrity of the speaker connections 26 and the functioning of the signal generator 62, pre-amplifier 126, power amplifier 164, and driver transformer 188 are being monitored continuously, by the one supervisory circuit 28.

When an alarm condition occurs as indicated by a signal applied from one of the sensing devices to one or more of the lines 12 feeding into the fire alarm control panel 10, the output lines 22 of the panel apply a reverse voltage to terminals E and F of the interface module. That is, terminal E becomes (+) with respect to terminal F. As a consequence, diode 198 becomes forward biased, energizing relay coil K4. The corresponding contacts K4A connect the relay coils K1 and K6 to the positive supply line 54, and thus terminals H and G of the interface module 34 are disconnected from terminals E and F respectively, and instead become connected to the secondary of the driver transformer 188. The output of the signal generator 62 is thus applied via the terminal L, to the stages 126 and 164, the driver transformer 188 and to the speakers 24.

With the swept-frequency alarm signal being transmitted to the speakers, a voice-override (signal shutdown) is made possible with the present circuit arrangement. The voice override can originate only at the master microphone 128, FIG. 4, which is preferably connected at the interface module 34 itself. Upon actuation of the push-to-talk switch 162 on the master microphone 128, a positive voltage is applied to the terminal Q, energizing coil K3, and is also applied through a resistor 216 and diode 218 and through the terminal U to the inverting input of the amplifier 66. The forward bias thus applied to the diode 218 causes shut-down of the signal generator 62. A capacitor 220 provides a short time delay to keep the signal generator silent during relay contact transfer. The blade of the contacts K3A becomes connected to its lower contact, so that the output of the bandpass filter (upper plate of capacitor 160) drives the stage 164. The preamplifier transistor 126 and power amplifier 164 now respond solely to voice commands originating at the master microphone 128. This feature of the present circuit is considered to be important in that it permits verbal instructions to be directed to all speakers 24 simultaneously, following the initial alert signal put out by the signal generator 62. Following the completion of the instructions, the push-to-talk switch 162 is released and the signal generator 62 automatically reactivated, continuing operation until the entire system is reset by the fire alarm control panel 10.

Also, indicator means are provided in the interface module 34 to confirm or verify the operativeness of the signal generator 62 and also to confirm the presence of modulation at the output of the driver transformer 188. In accomplishing this objective, one of the relay contacts K2B is connected to the supply line 60. With the coil K2 energized as a result of the presence of a signal at the transformer secondary, the contacts can, for example, be arranged to energize a green light such as an LED 222, through resistor 224. In the event of disappearance of the signal from the generator, resulting from failure of the generator itself, or of the amplifier or transformer circuitry, the coil K2 will open, causing the blade K2B to release, and result in energization of a yellow LED 226, through resistor 228, for example. These LED units can be located on the housing or casing of the interface module 34, in order to provide an indication of the operability of the circuitry noted above. In the event that the master microphone 128 is keyed, the signal generator 62 is automatically shut down, as described above, and the coil K2 will respond to audio (speech) originating to this master microphone. Thus, in the present example, the green and yellow LED units 222, 226 respectively will flicker alternately with one another, or in opposition, with the various voice peaks that occur during speech. If either the audio is not present at all, or is unusually weak, this flickering will not occur, since a weak audio signal will not energize coil K2. Thus a highly reliable modulation indicator is provided at the panel itself. This feature would be desirable for use with installations where the speaker or speakers 24 were located remotely from the interface module 34, such that the party giving the announcement could not hear the echo from a speaker, either because of distance or because of a high ambient noise level.

As noted above, the interface module 34 is powered entirely from the fire alarm control panel 10, and terminals A and B of the interface module 34 receive nominal 115 volt a.c. power from the panel 10. The panel's backup battery 16 is automatically switched into service when needed, by circuitry (not shown) in the alarm control panel 10. The back-up battery supplies 24 volts d.c. to terminals C and D of the interface module 34, and in addition supplies the power required by the fire alarm control panel to maintain the supervisory functions of the circuitry 28 and the supervisory and alarm monitoring functions for the lines 12 that are normally provided. If the 115 volt power supplied to lines 14 of the panel 10 is terminated, resulting in loss of a.c. power to terminals A and B of the interface module 34, coil K5 will de-energize. When a.c. power is being supplied, coil K5 is fed d.c. provided by a diode 230, and has a series resistor 232 and filter capacitor 234. The contacts associated with coil K5 are designated K5A. Dual sections are shown, providing redundancy, for increased reliability. Under conditions when the 115 volt power fails, the contacts K5A disconnect the signal generator 62 from the uninterrupted line 54, as well as disconnecting the preamplifier 126 and power stage 164 therefrom. If this occurs, the supervising of the signal generator, amplifier and transformer is temporarily lost until power is restored; however, the swept-frequency alarm capability as well as the voice override and announcement capability are maintained if an alarm condition arises. Assuming that coil K5 is de-energized as a result of a power failure, if an alarm is indicated on lines 12, the battery-supplied voltage to terminals E and F of the interface module 34 will reverse polarity, causing coil K4 to become energized. This in turn will energize coil K1, and contacts K1A and K1B will connect the speaker or speakers to the secondary of the driver transformer 188; in addition a resistor 236 will be connected across terminals E and F so that the fire alarm control panel 10 does not receive an indication of a fault in the system when the microphone is keyed. In effect, this resistor 236 constitutes a substitute for the end of line resistor 212. Contacts K1C connect the non-interrupted supply line 54 to the interrupted supply line 60, thereby providing power to the signal generator 62, amplifiers 126, 164 and microphone circuits, and initiating the transmission of the normal swept-frequency alarm over the speakers 24, while maintaining the voice override capability. The alarm will continue until the fire alarm control panel is re-set. Of course, the battery drain will be significant during this time, but in all likelihood the capacity will be sufficient to accomplish the desired result, i.e. evacuate the area or alert personnel that an emergency condition exists. By virtue of this power saver circuit, the current drawn by the interface module, when in a standby condition, can be reduced to around 5 milliamperes or less.

It is noted that even in the absence of an alarm condition, the signal generator 62 and amplifier circuit 126, 164 function continuously. It has been found that with the power levels employed at the driver transformer, the core thereof emits an audible sound as a result of minute vibration. Where the signal generator produces a "whoop" type signal, it can be heard rather distinctly at the location of the interface module 34 (i. e. at the location of the driver transformer 188). While not presenting any danger, it is considered to constitute a nuisance, as well as raising suspicion by unknowing parties that something may be wrong with the system.

Means are provided for disabling at least one of the amplifiers of the signal generator, whereby instead of a swept signal, a constant relatively low-frequency tone or "hum" is emitted by the voltage controlled oscillator. In accomplishing the momentary disabling of the sweep function, there is provided a clamping diode 238 connected through the terminal V to the noninverting input of the amplifier 96. In the absence of an alarm condition, the cathode of this diode is at low voltage, since there is no connection to it other than through the paralleled coils K1, K6 to ground, and the resistive path to ground is typically on the order of several hundred ohms. Accordingly the output of the amplifier 96 is held low, and the control line 68 of the voltage controlled oscillator is also low. The resulting frequency of the square wave emitted by the amplifier 66 is nominally 120 cycles or less, continuous, which produces a low-level hum in the driver transformer 188. It has been determined that this sound is not objectionable; nor does it raise suspicion, as might a "whoop" type sound. The arrangement is such that the diode 238 becomes reverse biased when K1 is energized and the signal generator is connected to power the loud speakers 24, however, so that only the desired, swept signal is ever broadcast to such speakers.

The capability of having one or more remote microphones or microphone modules has been incorporated in the arrangement of the present improved interface module. These preferably do not have the voice override feature of the master microphone 128, since it is considered that announcements of an emergency nature, and having priority override, should originate only at the location of the interface module 34. One such remote microphone module is shown in FIG. 4. Preferably the unit is of a construction similar to that of the master microphone, but incorporates a built-in preamplifier.

FIG. 4 shows, in addition to the master microphone 128, this remote microphone module, generally designated 240. It includes a dynamic microphone 242 and push-to-talk switch 244 having two poles, these parts being shown within the dotted outline. The microphone module has terminals O, Q, R, S and T for connection to the correspondingly-labelled terminals of the interface module 34. An on-off switch 246 is optionally provided in the supply line 248. Two by-pass capacitors 250, 252 filter the d.c. and insure that it is relatively free of undesirable noise which might otherwise appear on the signal transmitted by the remote microphone module 240. Bias for the microphone coil is provided by a fixed resistor 254. A resistor 256 constitutes an attenuator. Coupling capacitors 258, 260 and 262 accept the output from the microphone, and are fed to the inverting input terminals of two complementary amplifiers 264, 266 having input resistors 268, 270 and feedback resistors 272, 274 which determine the gain. A capacitor is connected from the non-inverting input terminals to ground. The amplifiers 264 and 266 are preferably contained in a single package, having positive and negative supply leads 273 and 275 respectively. The outputs of the amplifiers 264, 266 are connected through RC networks 276, 278 and 280, 282 respectively, to one section K7B of a relay, the relay coil being designated K7. One contact of section K7B extends to output terminal T, as shown. The diode 284 across coil K7 suppresses transients, as in the previous cases. Diode 286 provides redundancy or back-up for contacts K7A in the event of inadvertent failure thereof.

Diodes 288, 290, 292 and 294 limit the output voltage swing on terminal T to approximately 1.4 volts peak-to-peak. A low-value load resistor 300, typically under 50 ohms, is connected from the paralleled outputs to ground so as to provide a relatively low output impedance. This has the distinct advantage that shielded cable is not required where runs of even thousands of feet between the remote microphone module 240 and the interface module 34 are involved. Where higher impedance circuits are employed, as for example a microphone of 10K ohm impedance, pickup of stray signals becomes a problem, since long leads in relatively high impedance circuits tend to act like antennas, resulting in the the appearance of stray signals, noise, 60 Hz hum, and other signals of a spurious nature. With the present arrangement, problems of noise are virtually eliminated. In addition, with a low output impedance, the ability to drive virtually any type of load is maintained (i. e. multiple speakers in parallel).

Terminal T in FIG. 4 corresponds to terminal T on the interface module 34 of FIG. 2. In the interface module 34 is a series resistor 297 connected with the input of the bandpass filter (the junction of resistor 152 and capacitor 158). Audio from the remote microphone 242 is thus applied directly to the stage 164, as opposed to first being amplified by the preamplifier stage 126.

Also, means are provided for automatically inactivating such a remote microphone module 240 in the presence of an alarm condition wherein the signal generator is operative and is providing a swept frequency warning signal to the amplifiers, driver transformer and speakers. In accomplishing this objective, contacts K4A associated with the relay coil K4 are connected with a diode 296, FIG. 2, and the opposite end of the diode is arranged to provide power through terminal O, to the remote microphone module only when the coil K4 is de-energized, that is, when the d.c. voltage received from the fire alarm control panel corresponds to a supervisory condition as opposed to an alarm condition. Stated differently, when the voltage on terminal E is (+) with respect to that on terminal F, coil K4 is energized, and the blade of K4A is in engagement with the lower contact in FIG. 2. Accordingly, no voltage is applied to the anode of the diode 296, and operation of the remote microphone module is inhibited. Thus, a swept frequency alarm signal takes precedence or priority over any voice communication from a remote or slave microphone 242, whereas a voice announcement from the master microphone 128 takes precedence or priority over a swept frequency alarm signal. This particular priority that has been incorporated into the system is considered to be an important feature, both from the practical standpoint and from the safety standpoint. That is, inadvertent disruption of an alarm signal by personnel operating a remote microphone 242 for the purpose of making an announcement is effectively prevented.

Manual activation of an alarm by means of a suitable switch from a remote location, or from the interface module itself, is made possible by diode 298 and terminal W. The latter, when connected to terminal R, will initiate an alarm signal.

Further, means are provided on the interface module to establish a redundant feed to one or more of the speaker units 24, such that even if a feed wire 26 associated with a speaker is severed, all speakers will still respond to alarm signals or voice announcements. In accomplishing this, an additional relay coil K6 is provided, having two sets of contacts, the contacts being capable of connecting the secondary of the driver transformer 188 to terminals I and J of the interface module, as shown, when the coil K6 is energized. Under such circumstances a dual signal path is provided when the lead wires 26 are intact, whereas if one wire 26 breaks at any point along the length of the feed, there still exists a complete path between the transformer 188 and all of the speakers 24. Where connections such as those shown in the figure are employed, the end of line resistor 212 would be placed at terminals I and J, such that during supervisory activity at the fire alarm control panel, a break would be detected. (During supervisory activity or monitoring, the relay coil K6 is de-energized. If the end of line resistor were placed elsewhere, as for example between two of the three speakers shown, a break in the lines 26 beyond this resistor would not be detected by the supervisory circuit of the fire alarm control panel 10).

It is noted that the present interface module 34 can also be employed as a public address system at any time, even in the event of failure of the 115 volt a.c. power supplied through the panel 10 to the interface module 34, or open circuiting of terminals E and F of the control panel 10. When the master microphone relay coil K3 is activated, coils K1 and K6 are energized. In order to prevent the fire alarm control panel from interpreting public address activity as a system fault, contacts K1D are in series with resistor 236 across terminals E and F, such that at the same time that the speakers 24 are connected to the secondary of the driver transformer 188, this resistor 236 is simultaneously introduced across terminals E and F of the interface module 34. In this respect the resistor constitutes a substitute for the end of line resistor 212 that is employed with the supervision of the speaker circuits.

Also, when the interface module 34 is employed as a public address system, the relay coil K2 will respond to voice fluctuations by periodically opening and closing with the occurrence of voice peaks and pauses. This will in turn give rise to flickering of the LED units 222 and 226, thereby providing to the announcer an indication that the voice signal is being received at the transformer secondary, and with a magnitude that is at least above a level sufficient to energize relay coil K2. It can be readily appreciated that a weak signal will not provide this type of indication on the LED devices 222 and 226, since in the absence of a strong signal at the secondary of transformer 118 coil K2 will not become energized. An effective and highly reliable modulation indicator is thus provided, and is useable for both emergency and non-emergency situations.

Figure 6:
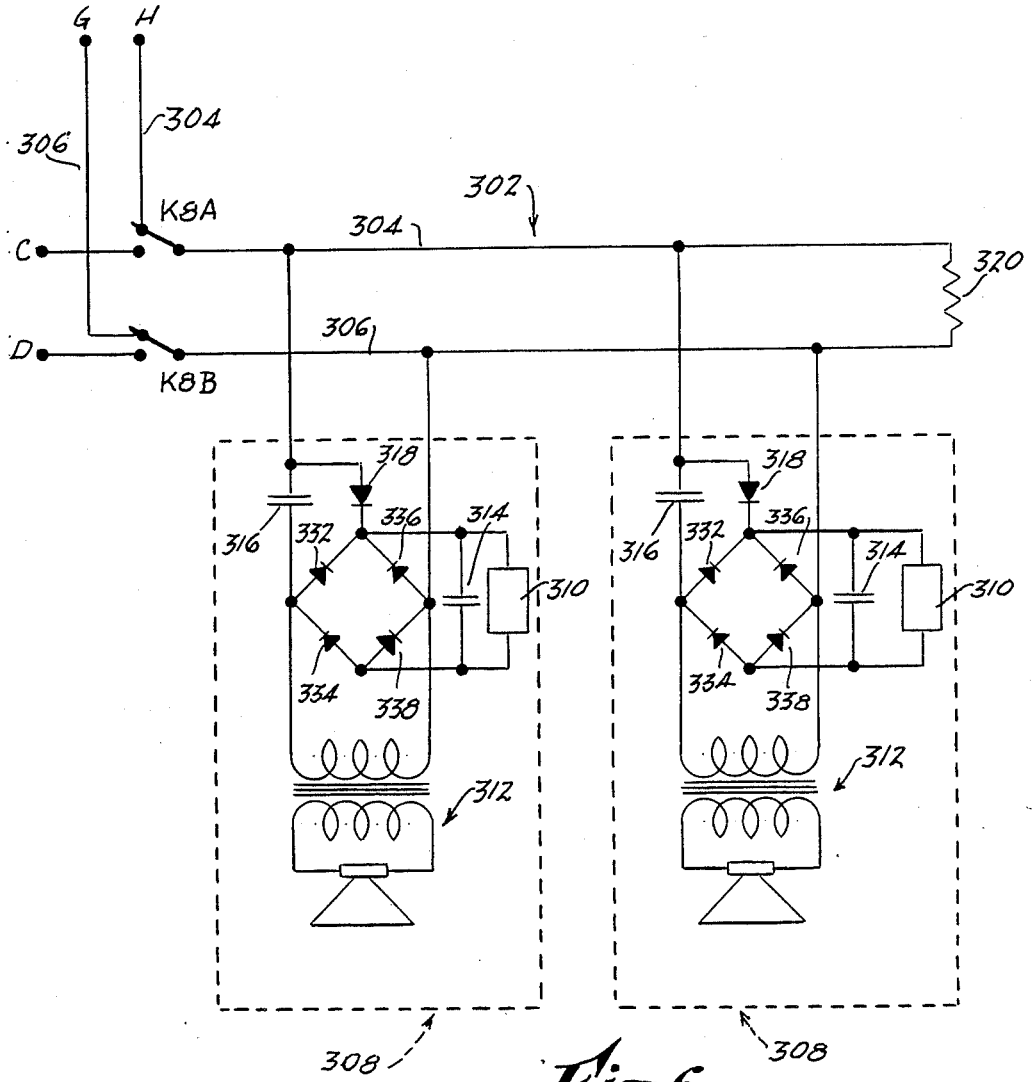
FIG. 6 is a schematic diagram of the two-wire speaker/light portion of the alarm system of the present invention, showing the details of each speaker/light unit.

Referring now to FIGS. 1 and 6, in accordance with the present invention, there is provided a novel and improved combination audible/visual alarm system generally designated by the numeral 302, adaptable for use with existing wiring installations even when the latter incorporate solely a two-wire line or circuit.

FIGS. 5 and 6 illustrate a two conductor transmission line or two-conductor circuit 304, 306 extending to a plurality of alarm units 308, each unit 308 having both audible and visual alarm indicating means, and wherein means are provided in the units 308 and in the interface module 34 for enabling selective operation of either: (1) solely an audible alarm mode from the units; or (2) solely a visual alarm mode from the units; or (3) a combination of both audible and visual alarm modes from said units.

In a preferred embodiment, the units 308 are identical with one another, each comprising a lamp 310, preferably a flashing light which is intended to be energized by d.c. and which is amplitude-responsive, i.e. it is characterized by a minimum threshhold voltage below which the flashing light will be rendered inoperative; and a sound transducer or loud speaker device 312 (with impedance matching transformer). Connected across the flashing light 310 of each unit is a filter capacitor 314. D.C. is provided by a bridge rectifier under certain conditions, which will hereinafter be explained. Blocking electrical components are also provided, comprising capacitors 316 and diodes 318. When considered with the diodes 318, the flashing lights 310 are also polarity-responsive. FIG. 5 shows four such units 308 in a two-wire system, connected as illustrated, with an end of line resistor 320.

Part of the structure which permits the operator of the system to switch alarm modes comprises a relay K8, FIG. 2, the relay being a double-pole, double-throw unit having contacts designated K8A and K8B, as shown in FIG. 6. The wiper blades extend to that portion of the transmission line 304, 306 to the right of the switch contacts K8A, K8B in FIG. 6, this line 304, 306 in turn being connected to the individual alarm units 308.

Two of the contacts K8A, K8B are intended to be permanently wired to the similarly labelled output terminals G, H of the interface module 34. (The purpose of the jumper wires between terminals G and J, and terminals H and I will be explained below). The remaining two contacts K8A, K8B extend to the similarly labelled output terminals C, D (indicated in FIG. 1 by the numeral 20) of the master control panel 10. Terminal C is maintained by the panel 10, at a nominal +24 volts d.c. with respect to terminal D. If desired, another source could be used to supply the terminals C, D in FIG. 6 with +24 volts d.c.

Referring to FIG. 2, the coil of the relay K8 is connected to the non-interrupted supply line 54 (FIG. 2) through a single pole, single throw switch 320. The switch 320 is normally open and the coil of relay K8 is de-energized. A transistor 322, constituting an inverter stage, has its emitter connected to the coil of relay K8, its collector grounded, and its base connected to a biasing resistor 324, which in turn extends to ground. A blocking diode 326 extends from the base of the transistor 322 to the common, non-grounded connection point for the coils of paralleled relays K1 and K6. These coils become energized whenever the module 34 receives a signal from terminals E and F of the control panel 10, to the effect that an alarm condition prevails, or in the event the microphone button 244 is depressed, for transmission of verbal communications.

Also, by the invention provision is made for reducing the amplitude of the output signal appearing on terminals G and H of the interface module 34, FIG. 2. In accomplishing this object, a tap 328 is included on the secondary winding of the transformer 188. It extends to a manually-operable switch 330, the position of which determines whether the output on terminals G and H of the interface module 34 is obtained from the outer legs of the secondary winding of the transformer 188, or from one leg and the transformer tap 328. In a preferred embodiment, the tap 328 can be a center tap.

The operation of the improved alarm system of the present invention can now be readily understood by referring to FIGS. 2 and 6. The switch 320 in FIG. 2 which is in series with the coil of relay K8, when closed, will give rise to operation of the flashing lights 310 only, of the individual alarm units 308, and is a manually operable switch that is accessible to the operator of the system at the location of the master panel 10 or interface module 34. In the absence of an alarm signal from terminals E and F of the master control panel 10, closing of the switch 320 will cause the coil of relay K8 to be energized, shifting the wiper blades of contacts K8A and K8B from the position shown in FIG. 6 to the opposite position. Under such circumstances, +24 volts d.c. is applied to units 308, and diodes 318 are thus forward biased providing d.c. power to the flashing lights 310. D.C. current does not flow through the primary of the transformers 312 due to the presence of capacitor 316. The diodes of the bridge rectifier in each unit 308 are labelled 332, 334, 336 and 338. Diode 338 conducts, whereas diodes 332 and 336 are reverse biased, and thus are non-conductive. Diode 334 is slightly forward biased, but not sufficient to conduct to any extent.

If the switch 320 in FIG. 2 is now opened, the coil of relay K8 will be de-energized, causing the contacts K8A and K8B to return to the positions illustrated in FIG. 6, and the flashing lights 310 will become extinguished. This switch 320 can be thought of as a "flashing light-only" switch, since it is capable of enabling the flashing lights without speaker energization, but only under conditions where a non-alarm condition exists in the interface module 34, and where no voice communications are being initiated, as will be explained below.

In the event that switch 320 has been closed, and an alarm condition is indicated by reversal of the voltage on terminals E and F of the master control panel 10, or alternately, a verbal message is initiated by depressing of the master microphone button 162, the appearance of positive voltage on the coils of relays K1 and K6 will forward bias diode 326, causing transistor 322 to cease conduction, de-energizing the coil of relay K8, and causing the contacts K8A and K8B to assume the position shown in FIG. 6, wherein the units 308 will be supplied with audio (either a siren-type signal, or speech) on the transmission line 304, 306. The audio signal in turn will be coupled through the capacitors 316 and fed to the speakers 312. In addition, such audio will be rectified by the rectifiers 332, 334, 336 and 338 of the bridge, filtered by capacitors 314, and applied to the flashing lights 310. Thus, a combined audible and visual alarm mode will ensue regardless of whether the "flashing light-only" switch 320 was open or closed. The "flashing light-only" mode is thus overriden when an alarm condition is indicated on terminals E and F of the master control panel, and is similarly overriden if a verbal message is being initiated, for transmission to the loud speakers. Stated differently, the circuitry disclosed prioritizes verbal messages over the "flashing light-only" mode, as well as prioritizing siren-type signals over such flashing light-only mode.

Further control of the visual/audible alarm mode is provided by the switch 330 that is connected to the transformer tap 328, FIG. 2. With the switch 330 in the position shown in solid lines, the full output voltage from the secondary of the transformer 188 is applied to terminals G and H of the module 34, and the units 308 will respond with simultaneous transmission to the speakers 312 of audio (either siren or speech), and operation of the flashing lights 310. If the switch 330 is now moved to the position shown in dotted outline, only one-half of the secondary voltage of transformer 188 will be applied to the terminals G and H, FIG. 2, a reduction in voltage of 6 db. The speakers 312 of the units 320 still, however, respond to the audio. The amplitude of the d.c. being applied to the flashing lights 310 is reduced 50%, and by proper choice of the operating parameters for the flashing lights 310, the resultant d.c. can be below the minimum voltage threshhold required to operate them. They thus constitute amplitude responsive light sources, or as referred to in some of the appended claims, "lamps", which term is intended to cover any type of light source. Accordingly, under such circumstances, the flashing lights 310 are rendered inoperative, while the audible or voice alarm signal emanating from the speakers 312 is retained with only a reduction in amplitude.

Thus, with the disclosed arrangement involving the diodes 318, 332, 334, 336, and 338, the blocking capacitors 316, relay K8, and switches 320, 330, complete control of the various alarm signals is had, namely: (1) solely an audible alarm mode emanating from the units 308; or (2) solely a visual alarm mode emanating from the units 308; or (3) a combination of both audible and visual alarm modes emanating from the units 308.

It is to be noted that the inclusion of the flashing lights 310 in the units 308 does not interfere with the supervision of the lines 304 and 306. In the absence of an alarm condition, the master control panel 10 provides a negative d.c. voltage on terminal E with respect to terminal F. With the coil of relay K8 de-energized, the contacts K8A and K8B are in the position shown in FIG. 6. Line 304 is thus negative with respect to line 306, which causes reverse bias to be applied to diodes 318. Blocking capacitors 316 similarly prevent current flow to the speaker transformers 312. Thus the supervisory d.c. current flow is solely through the lines 304 and 306, and through the end of line resistor 320 in FIG. 6, which is the intent of the supervisory function.

Further in accordance with the invention, and referring to FIG. 2, electrical jumper wires 340 and 342 are provided for contacts K1B and K6B; and for contacts K1A and K6A respectively. The jumper wires constitute a safety back-up function for the contacts, when a continuous loop transmission line such as that illustrated in FIG. 1 is employed with the interface module 34. In the present instance, by incorporating such jumper wires 340, 342, in the event of open-circuiting of one contact set, for example, K1B, the interface module 34 and transmission line 304, 306 would still be completely operative, since contacts K6B duplicate the function of contacts K1B. Thus, the reliability is significantly improved as regards the transmission of the output signal from the secondary of transformer 188, through relay contacts K1B, K1A, and K6A, K6B, and to terminals G and H. Reference is made to U.S. Pat. No. '685 noted above, which lacks such connections. As noted above, the disclosed arrangement is intended for use only where a "loop" type alarm transmission line 26, known in the trade as a Class A circuit, is available, as in FIG. 1.

From the above it can be seen that I have provided a novel and improved emergency alarm system which is both simple in construction and reliable in operation. The disclosed system makes it possible to employ a simple two-wire signal-carrying or transmission line with remotely-located units 308 that feature both audible and visual alarm modes. Complete control over the choice of modes is possible through the use of simple manually operated switches (320, 330) that can be readily manipulated by the operator. The system is useable with all existing two-wire alarm installations, thereby simplifying the initial installation, and eliminating the need for re-wiring, or the providing of additional circuits throughout an existing building or facility.

The disclosed arrangement is thus seen to represent a distinct advance and improvement in the field of emergency evacuation alarm systems.

Each and every one of the appended claims defines an aspect of the invention which is separate and distinct from all others and accordingly it is intended that each claim be treated as such when examined in light of the prior art devices in any determination of novelty of validity.

Variations and modifications are possible without departing from the spirit of the invention.

I claim:

1. A combination audio and visual alarm system for selectively generating either audible, or visual, or combined audible and visual alarm signals, comprising in combination:

(a) signal generating means for producing an audio signal on a pair of output terminals thereof, (b) a two-wire transmission line connected to said output terminals, (c) a unit containing a sound transducer and a polarity-responsive electrical lamp, and (d) means connected with said signal generating means, said transmission line, said sound transducer and said lamp, for selectively activating either the sound transducer by itself to be driven by the signal generating means, or the lamp by itself, or both the sound transducer and lamp simultaneously to be driven by the signal generating means.

2. The invention as set forth in claim 1, wherein:

(a) said activating means comprises a blocking capacitor in series with the sound transducer, for blocking d.c., and a rectifier circuit for rectifying the audio signal and converting it to d.c. for supplying the lamp.

3. The invention as set forth in claim 1, and further including:

(a) a source of d.c., (b) said activating means comprising an electric switch connected in said transmission line, and extending to said source of d.c. and said output terminals, (c) said switch selectively applying d.c. to said transmission line to activate the lamp without activating the sound transducer, or applying the audio signal to said transmission line to activate both the lamp and the sound transducer simultaneously.

4. The invention as set forth in claim 1, wherein:

(a) said lamp is amplitude-responsive, and has a driving amplitude threshhold level below which it is rendered inoperative, and (b) means for reducing the amplitude of the audio signal on said output terminals, whereby the said amplitude can be reduced to the point where the amplitude-responsive lamp is completely extinguished while the level of sound produced by the sound transducer is reduced only moderately.

5. The invention as set forth in claim 1, wherein:

a) said activating means comprises a blocking capacitor in series with the sound transducer, whereby the application of d.c. to the transmission line results in activation of the amplitude-responsive lamp while the sound transducer is rendered inoperative.

6. The invention as set forth in claim 1, and further including:

(a) an energy storage device connected across the lamp, and a rectifier circuit connected to the two-wire transmission line, whereby audio signals on said line are converted to d.c., and the energy storage device smooths out pulsations as might occur and appear at the lamp in the event that the audio signal comprises speech, thereby minimizing any tendency for the lamp to operate erratically under such circumstances.

7. The invention as set forth in claim 6, and further including:

(a) a blocking diode connected with said lamp, for inhibiting discharge of said energy storage device during the time that audio signal is being applied to the transmission line.

8. The invention as set forth in claim 1, wherein:

(a) said lamp comprises a flashing light.

9. The invention as set forth in claim 1, wherein:

(a) said sound transducer comprises an electrical loud speaker and a step-down, impedance matching transformer.

10. The invention as set forth in claim 1, wherein:

(a) said signal generating means has two pairs of output terminals, each pair being fed simultaneously with the said audio signal, and (b) a pair of electrical switches having contacts, one of said switches being in series with one of said output terminal pairs, and the other of said switches being in series with the other of said output terminal pairs, and (c) jumper wires connecting one terminal of one pair of terminals to one terminal of the other pair of terminals, and connecting the other terminal of said one pair of terminals to the other terminal of said other pair of terminals, to provide redundancy to the contacts of said electrical switches.

11. A combination audio and visual alarm system for selectively generating either audible, or visual, or combined audible and visual alarm signals, comprising in combination:

(a) a sound transducer device including a d.c. blocking means connected thereto, (b) a polarity-responsive electrical lamp, (c) a two-conductor circuit connected with said sound transducer device and with said lamp, (d) a source of d.c., (e) a source of audio signals, and (f) switching means for connecting said two-conductor circuit to either said d.c. source or said audio source, thereby to enable simultaneous operation of said sound transducer and lamp upon energization of the circuit by the source of audio, or to enable sole operation of the lamp when the circuit is energized by d.c.

12. The invention as set forth in claim 11, and further including a master control panel containing supervisory circuitry, alarm-activating terminals, and power supplies providing fixed sources of a.c. voltage and d.c. voltage, wherein:

(a) said source of d.c. is obtained from the d.c. voltage source of said master control panel.

13. The invention as set forth in claim 12, and further including:

(a) a microphone and amplifier for accepting verbal messages, (b) said source of audio signals comprising a signal generator, amplification means therefor, and voice-override circuitry for automatically disabling said generator if a verbal message is to be sent over the microphone to the sound transducer device.

14. An alarm system, for generating audible alarm signals, comprising in combination:

(a) signal generating means for producing an audio signal on a pair of output terminals thereof, (b) a two-wire transmission line connected to said output terminals, (c) an alarm unit containing a sound transducer and an amplitude-responsive electrical lamp having a driving amplitude threshhold level below which it is rendered inoperative, and (d) means for reducing the amplitude of the audio signal on said output terminals, whereby the said amplitude can be lowered to a point where the amplitude-responsive lamp is completely extinguished while the level of sound produced by the sound transducer is lowered only moderately.

15. The invention as set forth in claim 14, wherein:

(a) the reducing means attenuates the amplitude of the audio signal by roughly 6 decibels.

16. The invention as set forth in claim 14, wherein:

(a) the reducing means comprises an electric switch, and (b) a transformer having a tap, said switch being connected to said tap and extending to one of said output terminals.

17. The invention as set forth in claim 1, wherein:

(a) said signal generating means comprises electronic equipment for processing verbal communications to said unit, (b) said signal generating means further comprising a waveform generator circuit, for generation of a siren-type tone signal to be transmitted to said unit, and (c) selectively-controllable electrical circuit means for automatically overriding the waveform generator circuit when the verbal processing communications equipment is activated to transmit verbal communications to said unit, whereby transmission of said verbal communications to said unit will automatically take precedence over and block transmission of said tone signal thereto.

18. The invention as set forth in claim 1, and further including:

(a) selectively-controllable electronic circuit means for automatically overriding the operation of said lamp when the signal generating means is activated, whereby actuation of said signal generating means will automatically take precedence over and block energization of said lamp.

19. The invention as set forth in claim 1, wherein:

(a) said transmission line consists solely of two electrical conductor circuits.

20. The invention as set forth in claim 14, wherein:

(a) said transmission line consists solely of two electrical conductor circuits.

21. An audio-visual alarm device intended to be powered by an audio amplifier output signal, said device comprising in combination:

(a) a sound transducer, (b) a lamp, and (c) rectifier means connected with said sound transducer and said lamp, for rectifying the output signal and converting it to d.c. in order to energize the lamp.

22. The invention as set forth in claim 21, and further including:

(a) means including a blocking diode connected with said lamp and a blocking capacitor connected with said sound transducer, to permit selective activation of said lamp by d.c. without activating said sound transducer.

23. The invention as set forth in claim 22, and further including:

(a) means providing a source of supervisory d.c. voltage of a given polarity, (b) a transmission line, (c) an end of line resistor connected across said transmission line, and (d) a plurality of units each containing one sound transducer and one lamp, said units each having a pair of input terminals connected respectively to said transmission line, (e) said blocking diode means and said rectifier means being arranged to block said supervisory d.c. voltage of said given polarity applied to said input terminals, whereby said supervisory d.c. current does not flow through either the lamp or the transducer.

24. The invention as set forth in claim 23, wherein:

(a) said blocking diode means and said rectifier means are connected to said transducer and said lamp to enable simultaneous energization of said transducer and lamp when a.c. voltage is applied to said input terminals, and to enable solely energization of said lamp when d.c. of opposite polarity to that of the supervisory d.c. is applied to said input terminals.

25. An alarm system having a four-wire output circuit capability, comprising in combination:

(a) signal generating means having two pairs of output terminals, each pair being fed simultaneously with substantially identical electrical voltages, (b) a pair of electrical switches having contacts, one of said switches being in series with one of said output terminal pairs, and the other of said switches being in series with the other of said output terminal pairs, and (c) jumper wires connecting one terminal of one pair of terminals to one terminal of the other pair of terminals, and connecting the other terminal of said one pair of terminals to the other terminal of said other pair of terminals, to provide redundancy to the contacts of said electrical switches when two-wire transmission lines are being employed with said alarm system of four-wire capability.

* * * * *